US007575101B2

(12) United States Patent
Copsey

(10) Patent No.: US 7,575,101 B2
(45) Date of Patent: Aug. 18, 2009

(54) DEVICE FOR DETECTING OBJECTS ON A GLASS DOOR AND ELEVATOR EQUIPPED THEREWITH

(75) Inventor: Gary Copsey, Gien (FR)

(73) Assignee: Otis Elevator Company, Farmington, CT (US)

( * ) Notice: Subject to any disclaimer, the term of this patent is extended or adjusted under 35 U.S.C. 154(b) by 362 days.

(21) Appl. No.: 11/660,186

(22) PCT Filed: Sep. 3, 2004

(86) PCT No.: PCT/IB2004/002895

§ 371 (c)(1),
(2), (4) Date: Feb. 13, 2007

(87) PCT Pub. No.: WO2006/024893

PCT Pub. Date: Mar. 9, 2006

(65) Prior Publication Data

US 2007/0251765 A1 Nov. 1, 2007

(51) Int. Cl.
*B66B 13/14* (2006.01)

(52) U.S. Cl. ..... 187/316; 187/391; 49/26; 318/280

(58) Field of Classification Search ..... 187/313, 187/316, 317, 391; 49/25, 26, 28, 31, 128; 318/466–470, 280–286; 382/103, 325; 340/545.1, 340/552

See application file for complete search history.

(56) References Cited

U.S. PATENT DOCUMENTS

| | | | | |
|---|---|---|---|---|
| 3,816,745 | A | 6/1974 | Primm et al. | |
| 4,621,452 | A * | 11/1986 | Deeg | 49/28 |
| 5,581,944 | A * | 12/1996 | Kornbrekke et al. | 49/28 |
| 5,925,858 | A * | 7/1999 | Full et al. | 187/317 |
| 6,732,839 | B2 * | 5/2004 | Schuster | 187/391 |
| 7,044,271 | B2 * | 5/2006 | De Coi | 187/316 |

FOREIGN PATENT DOCUMENTS

| | | | |
|---|---|---|---|
| EP | 1 292 525 | B1 | 7/2004 |
| GB | 2 227 309 | A | 7/1990 |
| WO | WO 2004/058622 | A1 | 7/2004 |

OTHER PUBLICATIONS

International Preliminary Report on Patentability for PCT/IB2004/002895, dated Jul. 31, 2006.

* cited by examiner

*Primary Examiner*—Jonathan Salata

(57) ABSTRACT

A detector of foreign objects, and particularly fingers, between the doors and the contiguous walls of landing and car openings in an elevator with glass car and landing doors includes a light beam emitter and a receiver. The emitter, which is located near an opening frame edge of the car, emits a light beam that extends transversally across the car and landing glass doors from the vertical car opening frame edge to the opposite vertical landing frame edge. The receiver, which receives the emitted light beam, is adapted to detect any obstacle to the light beam and to order the simultaneous halt and reversal, as required, of the car and landing doors.

8 Claims, 1 Drawing Sheet

DEVICE FOR DETECTING OBJECTS ON A GLASS DOOR AND ELEVATOR EQUIPPED THEREWITH

FIELD OF THE INVENTION

This invention relates to a device for the detection of foreign objects, and particularly fingers, between the doors and the contiguous walls of an elevator car with glass doors, and to an elevator equipped therewith.

DESCRIPTION OF THE RELATED ART

Elevators with glass car and landing doors may entail a risk of fingers getting trapped in the space between the doors and the contiguous frame walls, particularly for children who are attracted by the impression of void created by the transparency of the doors.

However, a known device for the detection of foreign objects or obstacle is provided at the level of the landing doors, with a light beam covering each of the elevator landing doors laterally and in its plane. This device requires implanting a detection device at the level of each elevator landing door, and it is therefore relatively cumbersome to implement and expensive.

SUMMARY OF THE INVENTION

This invention aims at suppressing the disadvantages of existing devices and proposes a device for the detection of foreign objects, and particularly fingers, between the doors and the contiguous walls of landing and car openings in an elevator with glass car and landing doors, characterized in that it comprises a means to deliver a curtain-shaped light beam, located near an opening frame edge of the car, which beam extends transversally across said car and landing glass doors from the vertical car opening frame edge to the opposite vertical landing frame edge and across all of their respective lengths or heights, and a means to receive the emitted light beam and adapted to detect any obstacle to said transverse light beam and to order the simultaneous halt and reversal, as required, of car and landing door displacement at said elevator landing level, wherein the detection device is actuated by a car and landing door opening command at a determined storey in the building.

Said light beam emitted from a vertical car frame opening edge is advantageously reflected on the opposite vertical landing frame opening edge, e.g. by a strip-shaped vertical reflective surface arranged along the length of that vertical edge, and is received by said beam receiving means arranged on the car side.

Said reflective surface can have a regular concave cross-section along its height, in order to converge the reflected beam onto the beam receiving means.

Such a reflective surface can be formed by the polished surface of the landing frame edge, which can be made e.g. of stainless steel, reflective plastic, reflective glass etc.

Said beam receiving means can be a vertical light-receptive strip arranged near the vertical car opening frame edge and made e.g. of photoelectric cells arranged regularly along its length, wherein the electrical signals delivered thereby are transmitted to a door control circuit.

This arrangement as per the invention has the result that the detection device as per the invention is fitted only on the elevator car, whatever the type of door opening system—whether lateral, central, multi-section, or other. In addition, this equipment is compact and inexpensive.

This invention also relates to an elevator equipped with the detection device defined above.

BRIEF DESCRIPTION OF THE DRAWINGS

The invention is illustrated below on the basis of an exemplary embodiment with reference to the appended drawings, in which.

DETAILED DESCRIPTION

Figure 1:
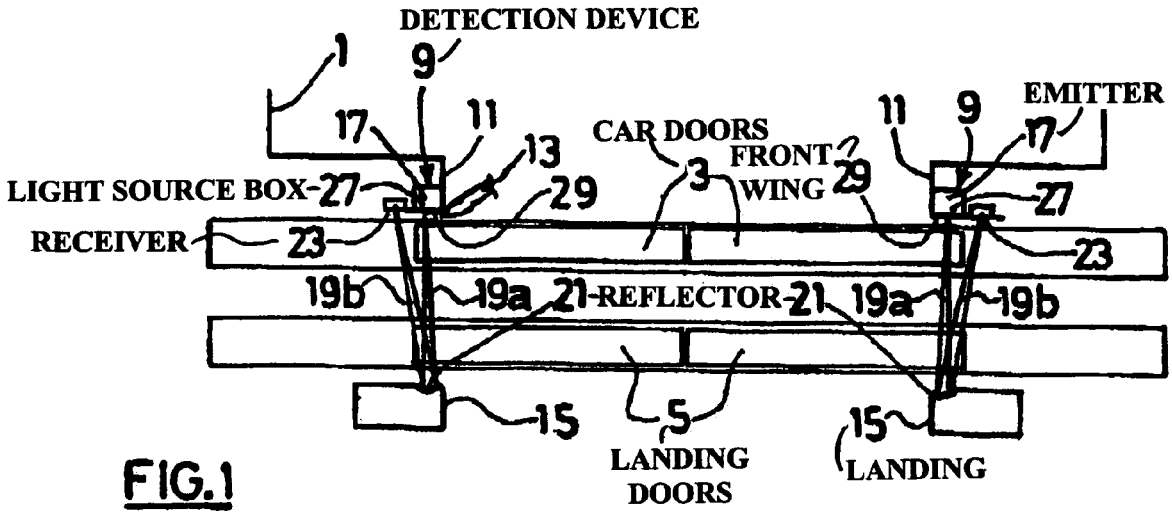
FIG. 1 is a schematic top view of the detection device as per the invention, operating on the car and landing glass doors of an elevator.

Referring now to FIG. 1, the obstacle detection device as per the invention, as represented in a top view, is fitted on an elevator car 1 equipped with two transparent glass doors 3 opening in the middle. Similarly, the corresponding doors 5 of the elevator landing 15 at each storey of the building are made of glass and transparent, wherein these landing doors 5 open and close in the middle synchronously with and parallel to the car doors 3.

Two detection devices 9 are used. These devices are identical. They are mounted in opposition, each on a vertical front edge 11 of the car opening frame in a symmetrical arrangement relative to a middle transverse plane of the car.

These detection devices 9 are designed to detect the presence of foreign bodies, and particularly fingers 13, between the opening frame edges of the car 11 and of the landing 15 and the car doors 3 and landing doors 5, respectively. These devices are actuated only by a car door opening command, for which there is a risk that objects or fingers 13 can be pulled inwards and trapped with a risk of injury. They are therefore inactive with the door closure command, when no object can be trapped.

Each detection device 9 comprises an emitting means 17 for a light beam 19*a*, a reflective means 21 to reflect the emitted beam and a receiving means 23 to receive the reflected beam 19*b*. The beam emitting 17 and receiving 23 means are arranged adjacent to each other on the vertical car opening frame edge 11.

Figure 2:
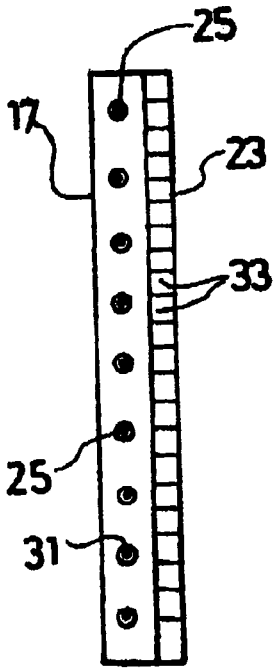
FIG. 2 shows the light emission and reception means on a vertical car opening frame edge.

The emitting means 17 (FIG. 2) is made of a series of unitary light sources 25 spaced regularly on a vertical line along the vertical car opening frame edge 11. These light sources 25 are each mounted in a box 27 attached on the back of the front wing 29 of the car frame profile edge 11. Each of these light sources 25 sends a light beam through a hole 31 drilled in said front profile wing 29. This beam is flat and perpendicular to said wing. The individual light beams emitted by the light sources 25 overlap and form the curtain-shaped light beam 19*a*, which diverges slightly outwards and is transversal to said car 3 and landing 5 glass doors. This beam 19*a* crosses the car and landing glass doors, extending from the vertical car opening frame edge 11 to the opposite vertical landing frame edge 15 and over all of their respective heights. It thus scans the entire space between the doors and the contiguous walls of the car and landing frame edge from top to bottom.

Figure 3:
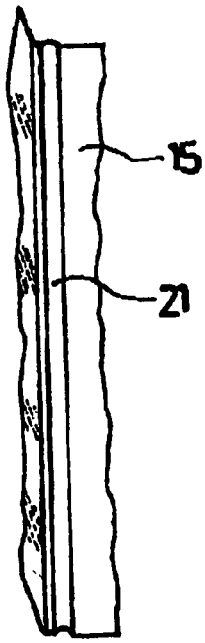
FIG. 3 shows the surface reflecting the emitted light beam on the landing opening frame edge.

The emitted beam 19*a*, after crossing the glass doors, is reflected at 19*b* on the opening frame edge 15 of the landing, opposite the car frame edge. It is reflected by said reflective means 21, which is made (FIG. 3) of a vertical reflective strip formed along the landing opening frame edge. This surface can be the stainless-steel type polished surface of the landing frame edge profile, which has a slightly concave cross-section to enable convergent reflection 19*b* of the emitted beam 19*a*. The width thereof corresponds to that of the emitted beam 19*a* that it receives.

The converging reflected beam 19*b* is received by said beam receiving means 23, which is made (FIG. 2) of a vertical light-receptive strip arranged on the car opening frame edge 11 near the line of light sources 25. This light-receptive strip can be made of photoelectric cells 33 arranged regularly on its length along said edge, the outputs of which are connected in series to a door opening control circuit of the elevator (not shown).

It can then be understood that if an obstacle, particularly a finger 13, enters the space between the doors and the contiguous opening frame edges, such obstacle blocks the light beam 19*a* emitted by the emitting means where it is located, which produces a more or less light spot on the light-receptive strip 23 and therefore a weak output signal or no signal from the corresponding photoelectric cell or cells, so that said door control circuit triggers the halt or reverse motion of the door opening, according to how the latter is programmed. Thus the obstacle or finger can be withdrawn and the opening of the doors can then continue.

It should be noted that the device can be mounted on any type of elevator with glass car and landing doors, with one or several sections, with a lateral (one detector only) or central opening, and with clear or slightly stained glass.

In addition, the emitting and receiving means 17 and 23 can of course be mounted in the same box, and the emission and reflection of the light beam can occur in the same plane (the plane of the light sources 25).

Furthermore, the emitter light sources are not limited to visible light sources, but infrared light sources or other non visible wave lengths light are also contemplated.

In place of the polished stainless-steel reflective surface, reflective plastic or glass surface may be used.

The invention claimed is:

1. Device for the detection of foreign objects, and particularly fingers, between the doors and the contiguous walls of landing and car openings in an elevator with glass car and landing doors, the device comprises:

a light beam emitter located near an opening frame edge of the car, the emitter delivers a beam that extends transversally across the car and landing glass doors from a vertical car opening frame edge to an opposite vertical landing frame edge, and a receiver located on the vertical car opening frame edge and near the light beam emitter, the receiver to receive the emitted beam and adapted to detect any obstacle to the transverse light beam and to order a simultaneous halt and reversal, as required, of car and landing door displacement at the elevator landing level, wherein the detection device is actuated by a car and landing door opening command.

2. Detection device as per claim 1, wherein the light beam emitted from a vertical car frame opening edge is reflected on the opposite vertical landing frame opening edge by a strip-shaped vertical reflective surface arranged along the length of that vertical edge, and is received by the receiver arranged on the car side.

3. Detection device as per claim 2, wherein the reflective surface has a regular concave cross-section along its height, in order to converge the reflected beam onto the receiver.

4. Detection device as per claim 2, wherein the reflective surface is formed by the polished surface of the landing frame edge, which can be made of stainless steel, reflective plastic, or reflective glass.

5. Detection device as per claim 1, wherein the receiver is a vertical light-receptive strip arranged near the vertical car opening frame edge.

6. Detection device as per claim 5, wherein the light-receptive strip is made of photoelectric cells arranged regularly along its length, wherein the electrical signals delivered thereby are transmitted to a door control circuit of the elevator.

7. Detection device as per claim 1, wherein the emitter is made of a series of unitary light sources spaced regularly on a vertical line along the vertical car opening frame edge, which light sources are each mounted in a box attached on the back of the front wing of the car frame profile edge and which light sources each send a light beam through a hole drilled in the front profile wing, wherein this beam is flat and perpendicular to the wing, and the individual light beams emitted by the light sources overlap and form the curtain-shaped light beam, which diverges slightly outwards and is transversal to the car and landing glass doors.

8. Elevator with glass car and landing doors, wherein the elevator is fitted with a device to detect objects as per claim 1.

* * * * *